US009305725B2

(12) United States Patent
Yoshida et al.

(10) Patent No.: US 9,305,725 B2
(45) Date of Patent: Apr. 5, 2016

(54) SWITCHING APPARATUS

(71) Applicant: Mitsubishi Electric Corporation, Chiyoda-ku, Tokyo (JP)

(72) Inventors: Tadahiro Yoshida, Tokyo (JP); Toshihiro Matsunaga, Tokyo (JP); Toru Kimura, Tokyo (JP); Koichi Kagawa, Tokyo (JP); Hideki Miyatake, Tokyo (JP); Munetaka Kashiwa, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/428,768

(22) PCT Filed: Jun. 7, 2013

(86) PCT No.: PCT/JP2013/065838
§ 371 (c)(1),
(2) Date: Mar. 17, 2015

(87) PCT Pub. No.: WO2014/080655
PCT Pub. Date: May 30, 2014

(65) Prior Publication Data

US 2015/0248977 A1 Sep. 3, 2015

(30) Foreign Application Priority Data

Nov. 21, 2012 (JP) ..... 2012-254854

(51) Int. Cl.
*H01H 33/662* (2006.01)
*H01H 33/66* (2006.01)
(Continued)

(52) U.S. Cl.
CPC ..... *H01H 33/664* (2013.01); *H01H 33/662* (2013.01); *H01H 33/6606* (2013.01); *H01H 33/666* (2013.01)

(58) Field of Classification Search
CPC . H01H 33/662; H01H 33/664; H01H 33/666; H02B 1/20; H02B 13/02
USPC ..... 218/120, 123, 125, 134, 139, 140, 153, 218/154
See application file for complete search history.

(56) References Cited

U.S. PATENT DOCUMENTS 4,323,871 A * 4/1982 Kamp ..... H01H 85/46 337/7
2011/0000886 A1 1/2011 Isoya et al.
2012/0312667 A1 12/2012 Hasegawa et al.

FOREIGN PATENT DOCUMENTS

JP 56-148841 U 11/1981
JP 4-184830 A 7/1992
(Continued)

OTHER PUBLICATIONS

International Search Report (PCT/ISA/210) mailed on Jul. 2, 2013, by the Japanese Patent Office as the International Searching Authority for International Application No. PCT/JP2013/065838.
(Continued)

*Primary Examiner* — Renee Luebke
*Assistant Examiner* — William Bolton
(74) *Attorney, Agent, or Firm* — Buchanan Ingersoll & Rooney PC

(57) ABSTRACT

Provided are: a vacuum interrupter having a fixed contact and a movable contact; a fixed side mounting plate which supports a fixed side conductor; and an operating mechanism which is coupled to a movable side conductor and performs opening and closing operation of both the contacts. The fixed side mounting plate is configured such that a plurality of plate-like members are overlapped; an exposed portion of the fixed side conductor is attached with a divided terminal which has a fitting hole to be fitted to the exposed portion and is formed with a slit in a radial direction from the fitting hole; and the divided terminal is fixed to the fixed side mounting plate and the fixed side conductor is supported by the fixed side mounting plate via the divided terminal.

9 Claims, 3 Drawing Sheets

(51) Int. Cl.
*H01H 33/666* (2006.01)
*H01H 33/664* (2006.01)

(56) References Cited

FOREIGN PATENT DOCUMENTS

| | | | |
|---|---|---|---|
| JP | 10-247444 | A | 9/1998 |
| JP | 2005-259562 | A | 9/2005 |
| JP | 2006-164654 | A | 6/2006 |
| WO | WO 2009/125467 | A1 | 10/2009 |
| WO | WO 2011/111086 | A1 | 9/2011 |

OTHER PUBLICATIONS

Decision to Grant a Patent mailed on Feb. 10, 2015, by the Japanese Patent Office for Application No. 2014-547585.

* cited by examiner

SWITCHING APPARATUS

TECHNICAL FIELD

The present invention relates to a switching apparatus for use in power receiving and transforming facilities.

BACKGROUND ART

Generally, when a pair of contacts in an open contact state are closed (close contact) at a certain speed in a power switching apparatus, bounce is generated between the contacts. The bounce is generally referred to as chattering. A voltage is applied between the contacts; and accordingly, an arc is generated by the chattering and a contact surface is roughened or ablated, so that, there is a demerit that contact resistance unnecessarily increases. Furthermore, a problem exists that when duration time of the chattering is long, the contacts fuse; and thus, the duration time of the chattering needs to be shortened as much as possible.

As a conventional switching apparatus taking into account suppression of the chattering, for example, there is disclosed a configuration in which, in a switching apparatus equipped with a vacuum interrupter having a fixed contact and a movable contact, the fixed contact side is fixed to an insulation support base via a fixed conductor and an elastic body. A fixing conductor portion serves as chattering suppression means; and the fixed conductor is composed of a multi-layer plate and is directly connected to the fixed contact so as not to interpose a member, which gives an influence on a chattering equal to or less than several kHz in natural vibration frequency, between the contacts. A plurality of minute collisions are repeated between the multi-layer plate at the time of contact closing; and thus, kinetic energy is consumed to suppress the duration time of the chattering (for example, see Patent Document 1).

RELATED ART DOCUMENT

Patent Document

Patent Document 1: JP-A-2006-164654 (Page 3, FIG. 1)

OUTLINE OF THE INVENTION

Problems to be Solved by the Invention

According to the conventional switching apparatus shown in Patent Document 1, the fixed conductor serving as the chattering suppression means is composed of at least three or more multi-layer plate in order to relax impact and the fixed conductor is supported by the insulation support base via the elastic body. The fixing conductor portion directly connected to the fixed side of the vacuum interrupter serves as an energization path to which a high voltage and/or a large current is applied. In order to configure this energization path, a fixed side terminal to be connected to a main circuit needs to be connected to the fixed conductor by bolt clamping or the like. A high electric field is generated at the connection portion, corner portions of the multi-layer plate, and component end portions of the elastic body; and accordingly, there needs to be taken measures of electric field relaxation, for example, an electric field relaxation shield which is like covering the whole of their portions is arranged on the whole periphery of a fixed side conductor portion and a problem exists in that a structure is complicated when the configuration of Patent Document 1 is applied to an actual switching apparatus.

The present invention has been made to solve the above described problem, and an object of the present invention is to provide a switching apparatus which can suppress chattering at the time of contact closing by a simple configuration while easily securing an energization path and taking into account electric field relaxation.

Means for Solving the Problems

A switching apparatus according to the present invention includes: a vacuum interrupter in which a fixed contact and a movable contact are contained in a vacuum vessel; a fixed side mounting plate which supports a fixed side conductor connected to the fixed contact; an insulation support which supports the fixed side mounting plate in a bridge form by at least two supporting portions at intervals; and an operating mechanism which is coupled to a movable side conductor connected to the movable contact and performs opening and closing operation of both the contacts. In the switching apparatus, the fixed side mounting plate is configured such that a plurality of plate-like members are overlapped; and the fixed side conductor of the vacuum interrupter is supported at substantially the center of the two supporting portions of the fixed side mounting plate directly or via an impact force transmitting member.

Furthermore, a switching apparatus includes: a vacuum interrupter in which a fixed contact and a movable contact are contained in a vacuum vessel; a fixed side mounting plate which supports a fixed side conductor connected to the fixed contact; and a cylindrical insulation support in which the vacuum interrupter is contained in the inside and to which the fixed side mounting plate is firmly fixed at one end side; and an operating mechanism which is coupled to a movable side conductor connected to the movable contact and performs opening and closing operation of both the contacts. In the switching apparatus, the fixed side mounting plate is configured such that a plurality of plate-like members are overlapped; an exposed portion of said fixed side conductor exposed to the outside of the vacuum vessel is attached with a divided terminal which has a fitting hole to be fitted to the exposed portion and is formed with a slit in a radial direction from the fitting hole; and the divided terminal is fixed to the fixed side mounting plate, and the fixed side conductor of the vacuum interrupter is supported by the fixed side mounting plate via the divided terminal.

Advantageous Effect of the Invention

According to the switching apparatus of the present invention, the fixed side mounting plate which supports the fixed side conductor of the vacuum interrupter is configured such that the plurality of plate-like members are overlapped and the fixed side conductor of the vacuum interrupter is supported at substantially the center of two supporting portions of the fixed side mounting plate directly or via the impact force transmitting member, whereby collision energy during contact closing operation is attenuated by the fixed side mounting plate portion and chattering between the contacts can be effectively suppressed.

Furthermore, the fixed side mounting plate is configured such that the plurality of plate-like members are overlapped; the exposed portion of the fixed side conductor exposed to the outside of the vacuum vessel is attached with the divided terminal which is to be fitted to the exposed portion; the divided terminal is fixed to the fixed side mounting plate, and the fixed side conductor of the vacuum interrupter is supported by the fixed side mounting plate via the divided terminal, whereby collision energy during contact closing operation is attenuated by the divided terminal and the fixed side mounting plate portion and chattering between the contacts can be effectively suppressed.

In addition, the divided terminal is used, whereby the number of the laminated sheets of the fixed side mounting plate can be reduced and a reduction in size of the switching apparatus can be achieved.

MODE FOR CARRYING OUT THE INVENTION

Embodiment 1

Figure 1A:
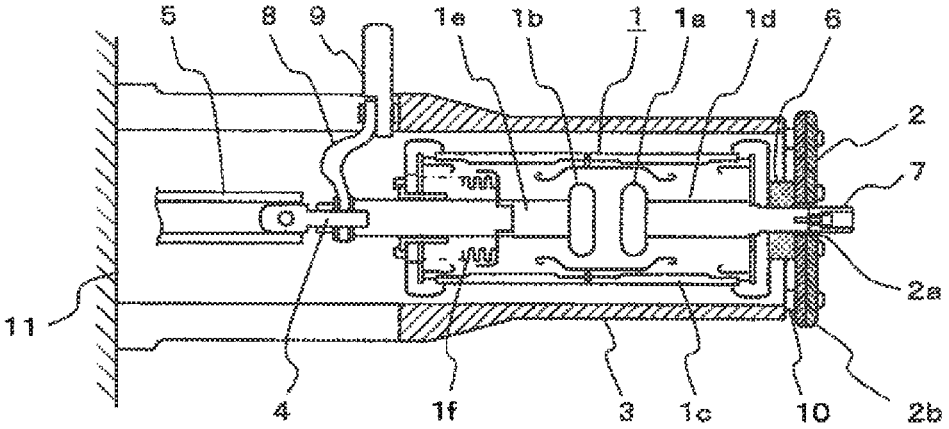
FIG. 1A is a side sectional view showing a switching apparatus according to Embodiment 1 of the present invention.
Figure 1B:
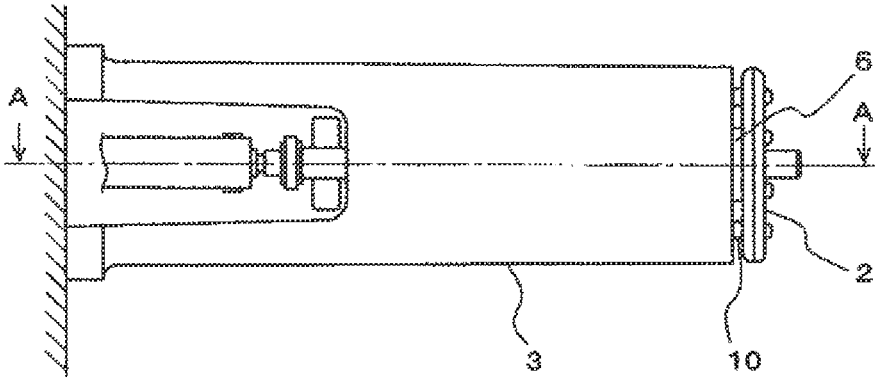
FIG. 1B is a bottom view thereof.

FIG. 1A is a side sectional view showing a switching apparatus according to Embodiment 1 of the present invention, and FIG. 1B is a bottom view thereof. Incidentally, FIG. 1A is the sectional view taken along the central axis A-A of FIG. 1B.

First, description will be made from an outline of the whole configuration of the switching apparatus.

In FIGS. 1A and 1B, the switching apparatus has a vacuum interrupter 1 in which a fixed contact 2*a* and a movable contact 2*b* are contained in a vacuum vessel 2*c*; a fixed side mounting plate 2 on which the fixed side of the vacuum interrupter 1 is mounted to be supported and fixed; an insulation support 3 which insulatively supports the vacuum interrupter 1 and the fixed side mounting plate 2; a coupling rod 4 connected to the movable side of the vacuum interrupter 1; and an insulation rod 5 whose one end is coupled to the coupling rod 4 and whose other end is coupled to an operating mechanism (not shown in the drawing) to insulate the vacuum interrupter 1 from the grounding side and to transmit the driving force of the operating mechanism to the coupling rod 4 side.

Next, each portion will be described in more detail. One end of a fixed side conductor 1*d* is firmly fixed to the fixed contact 1*a* of the vacuum interrupter 1; and the other end side thereof is led out to the outside from a fixed side end plate portion of the vacuum vessel 1*c*. An exposed portion of the fixed side conductor 1*d* led out to the outside is attached with a divided terminal 6; and the divided terminal 6 is attached to the fixed side mounting plate 2. Then, the fixed side mounting plate 2 is fixed to one of opening ends of the cylindrically shaped insulation support 3. Therefore, the fixed side conductor 1*d* is supported and fixed to the fixed side mounting plate 2 via the divided terminal 6 and the fixed side mounting plate 2 is fixed to the insulation support 3; and thus, the vacuum interrupter 1 is supported inside the insulation support 3. The details of the divided terminal 6 and the fixed side mounting plate 2 will be described later. A fixed side connection terminal 7 to be connected to an external main circuit conductor is firmly fixed on the leading end side of the fixed side conductor 1*d*.

On the other hand, one end side of the movable side conductor 1*e* is firmly fixed to the movable contact 1*b*; and the other end side thereof is led out to the outside from the movable side end plate portion of the vacuum vessel 1*c* via a bellows 1*f*. A female screw is formed on an end portion of the movable side conductor 1*e* led out to the outside; and a male screw portion of the coupling rod 4 is screwed to the female screw portion and is fastened by a nut. On this occasion, a flexible conductor 8 is also fastened together. A movable side connection terminal 9 is connected to the flexible conductor 8. The insulation rod 5 to be connected to the coupling rod 4 is formed in a cylindrical shape with fiber reinforced epoxy or the like; and both ends thereof are each provided with a hole for pin coupling.

The movable contact 1*b* of the vacuum interrupter 1 is integrated with the movable side conductor 1*e*, the coupling rod 4, and the insulation rod 5 and is driven in the left/right direction in the drawing by the driving force from the operating mechanism (not shown in the drawing); and thus, the switching apparatus interrupts a large current generated in an energization path thereof or is closed.

The insulation support 3 is formed in a substantially cylindrical shape with an insulation member such as an epoxy resin; and the vacuum interrupter 1 and a movable portion such as the insulation rod 5 are contained inside thereof. An embedded metal (see an enlarged drawing of FIG. 4) which is for fastening to the fixed side mounting plate 2 is embedded in an opening end portion of the insulation support 3 on the side on which the fixed side mounting plate 2 is mounted. The fixed side mounting plate 2 is fixed to the insulation support 3 by bolt clamping via a spacer 10 by using the embedded metal. The spacer 10 has approximately the same diameter as the embedded metal; and a through hole through which a fastening bolt passes through is provided at the center thereof.

The other opening end portion of the insulation support 3 on the side in which the insulation rod 5 is contained is attached to a fixing plate 11 serving as a grounding portion and the whole switching apparatus is fixed to the fixing plate 11. Incidentally, the fixing plate 11 is a member provided on the housing side in which the switching apparatus is contained.

Next, the details of the fixed side mounting plate 2 will be described.

As shown in FIGS. 1A and 1B, the fixed side mounting plate 2 is configured such that two plate-like members having the same outer shape slightly larger than an opening portion of the insulation support 3 are overlapped. The outer shape may be a circle in accordance with the opening portion of the insulation support 3 or may be a rectangle as to be described later.

Aluminum alloy or stainless is preferable for a material of the fixed side mounting plate 2. In the case of aluminum alloy, the fixed side mounting plate 2 can be used as a conductor; and therefore, for example, a connection conductor like the fixed side connection terminal 7 does not need to be provided and the external main circuit conductor can be directly connected to the fixed side mounting plate 2. In this regards, however, as for a loss factor showing the damping characteristics of the metal material, stainless is about ten times as large as that of aluminum alloy and stainless has characteristics that are easily attenuated against input vibration.

FIGS. 1A and 1B exemplify a case where stainless is used. Therefore, the before described fixed side connection terminal 7 is attached at a leading end of the fixed side conductor 1*d* of the vacuum interrupter 1. A through hole 2*a* having an inner diameter larger than the outer diameter of the fixed side connection terminal 7 is provided at a central portion of the fixed side mounting plate 2; and the external main circuit conductor is connected to the fixed side connection terminal 7 exposed to the outside by passing through the through hole 2*a*.

Incidentally, the fixed side connection terminal 7 is not a different member, but may be formed integrally with the fixed side conductor 1*d*.

An outer peripheral portion of the fixed side mounting plate 2 is a high electric field. Consequently, a portion serving as a corner portion of the outer periphery of the overlapped fixed side mounting plate 2 is provided with a curved face portion 2*b* formed in a curved face so as not to be an edge in consideration of electric field relaxation.

Figure 2A:
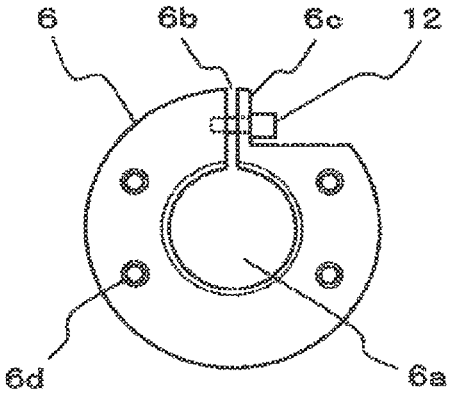
FIG. 2A is a detailed plan view showing a divided terminal of the switching apparatus of FIGS. 1A and 1B.

Next, the details of the divided terminal 6 which connects the fixed side conductor 1*d* of the vacuum interrupter 1 to the fixed side mounting plate 2 will be described. FIG. 2A is a detailed plan view showing the divided terminal 6 seen in the axial direction of the vacuum interrupter 1; and FIG. 2B is a side view thereof.

The outer shape of the divided terminal 6 is a disc shape and a central portion thereof is provided with a fitting hole 6*a* to be fitted to an exposed portion of the fixed side conductor 1*d* exposed from the vacuum vessel 1*c* to the outside. Then, a slit 6*b* that is slit in a radial direction from the fitting hole 6*a* is provided; and in order to screw-fasten the slit 6*b* portion from the outside, a configuration is made such that a flat portion 6*c* is provided by cutting a part of an outer peripheral portion so as to be capable of fastening with a fastening screw 12 by using a fastening hole formed in the flat portion 6*c*. Further, mounting holes 6*d* for attaching the fixed side mounting plate 2 are provided.

Assembly of the divided terminal 6 is made such that the divided terminal 6 is fitted to the exposed portion of the fixed side conductor 1*d* and then fixed to the fixed side conductor 1*d* by fastening the fastening screw 12 inserted from the flat portion 6*c* at a predetermined position.

Figure 2B:
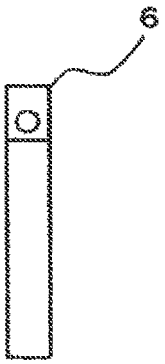
FIG. 2B is a side view thereof.

FIGS. 2A and 2B exemplify the divided terminal 6 in which a female screw is formed on the inner peripheral side of the fitting hole 6*a*. In this case, a male screw is formed on the outer peripheral side of the exposed portion of the fixed side conductor 1*d* to be fitted to the female screw. Assembly is made such that the female screw of the divided terminal 6 is screwed to the exposed portion of the fixed side conductor 1*d* and is fixed by fastening the fastening screw 12 at the predetermined position. In such a manner, in the case of fitting by providing the screw portion, such a fitting can be firmly fitted than in the case of cylindrical insertion, and the fitting portion can be effectively prevented from coming off or coming loose due to, for example, vibration during contact opening or closing.

The outer shape of the divided terminal 6 shown in FIGS. 2A and 2B is the disc shape; however, a portion where the divided terminal 6 is used is the inside surrounded by the fixed side mounting plate 2 and the insulation support 3 and therefore the divided terminal 6 is not necessarily formed in the disc shape.

Figure 3A:
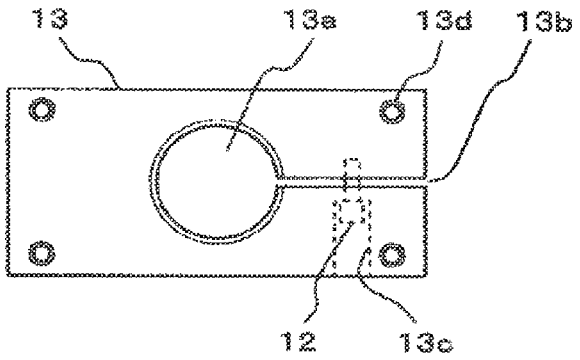
FIG. 3A is a detailed plan view showing other embodiment of the divided terminal of the switching apparatus of FIGS. 1A and 1B.
Figure 3B:
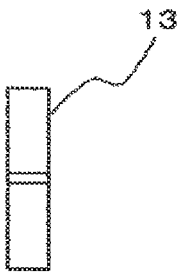
FIG. 3B is a side view thereof.

FIG. 3A is a detailed plan view showing other example of a divided terminal 13 in the case where the outer shape thereof is a cuboid; and FIG. 3B is a side view thereof. As in FIGS. 2A and 2B, a fitting hole 13*a* is provided at a central portion and a female screw is formed on the inner peripheral side thereof. A slit 13*b* is provided by slitting a part of the fitting hole 13*a* in a radial direction; a screwing hole 13*c* for the fastening screw 12 which is for fastening the slit 13*b* portion; and mounting holes 13*d* which are for attaching the fixed side mounting plate 2 are provided. In the case where the outer shape is the cuboid, processing is easier than in the case of the disc shape and therefore manufacture can be made inexpensively. The fitting hole 13*a* may be a cylindrical insertion system without providing the female screw.

Incidentally, in the following description, a portion to be described as the divided terminal 6 is equivalent, even when the divided terminal 6 is substituted with the divided terminal 13.

Figure 4:
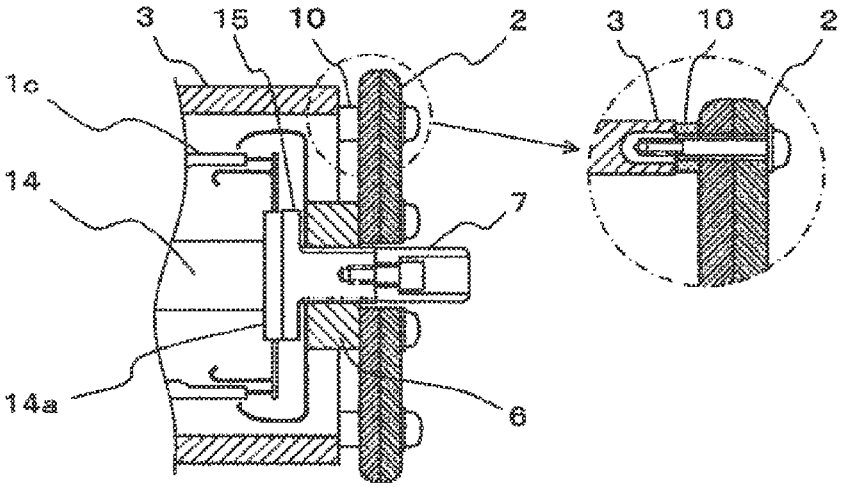
FIG. 4 is a partial sectional view showing other example of the switching apparatus according to Embodiment 1 of the present invention.

Next, a modified embodiment of the fixed side conductor of the vacuum interrupter 1 will be described by FIG. 4. FIG. 4 is a partial sectional view showing only the vicinity of the fixed side of the vacuum interrupter 1.

In the previous FIGS. 1A and 1B, the other end side of the fixed side conductor 1*d* whose one end is connected to the fixed contact 1*a* is led out to the outside by passing through the fixed side end plate of the vacuum vessel 1*c*; however, a fixed side conductor 14 shown in FIG. 4 is a disc shaped portion 14*a* in which a portion passing though the fixed side end plate of the vacuum vessel 1*c* is a disc shape. The vacuum interrupter is standardized to some degree and there is also a case of the fixed side conductor 14 like FIG. 4. In this case, the divided terminal 6 cannot be directly connected; and therefore, first, a connection conductor 15 is attached to the disc shaped portion 14*a* of the fixed side conductor 14 by bolt clamping or the like and the fixed side connection terminal 7 is attached to the leading end side thereof. A male screw to be screwed to the female screw of the fitting hole 6*a* of the divided terminal 6 is formed on the outer peripheral side of the connection conductor 15.

A state where the fixed side conductor 14 and the connection conductor 15 are combined is equivalent to the fixed side conductor 1*d* of FIGS. 1A and 1B; and therefore, in the case of being referred to as "fixed side conductor" in the present invention, the fixed side conductor also includes a shape in which the fixed side conductor 14 and the connection conductor 15 of FIG. 4 are combined.

Incidentally, the fixed side connection terminal 7 may be formed integrally with the connection conductor 15.

The operation of the thus configured switching apparatus of the present embodiment will be described.

When the fixed contact and the movable contact in an open contact state are closed (close contact) at a certain speed by a closing command, chattering is generated between the contacts.

In order to suppress a chattering phenomenon, collision energy needs to be attenuated or dissipated while a surrounding fixing portion has a certain spring constant and distorts in response to an impact load during contact closing operation.

In an insulation supporting structure like Embodiment 1, it has been found by experimental validation of inventors that it is effective for suppression of chattering by setting a spring constant of the fixed side mounting plate 2 to be equal to or less than 10 to 100 kN/mm. Then, it has been found that if the insulation supporting structure like Embodiment 1 is adopted, determination of the above spring constant can be achieved even when the number of laminated sheets of the fixed side mounting plate 2 is two sheets. Therefore, in the switching apparatus of the present application, the thickness and the shape of the fixed side mounting plate 2 is determined so that the spring constant is within the above range.

The fixed side mounting plate 2 can be composed of two plate-like members; and thus, the number of components can be reduced and a reduction in size of the switching apparatus can be achieved. Furthermore, a period of time required for assembly preparation (cleaning or the like) and/or assembly can be shortened and costs of surface finishing can also be reduced.

Further, in this structure, the impact energy during contact closing of the switching apparatus is transmitted to the divided terminal 6 via the fitting portion of the fixed side conductor 1*d* and then transmitted to the fixed side mounting plate 2. In this case, when the impact energy is transmitted via the fitting portion of the divided terminal 6, a part of the impact energy is dissipated by the friction of the fitting portion.

Therefore, in the case where the fitting portion of the fixed side conductor 1*d* and the divided terminal 6 is screw-joined, a dissipation effect of the impact energy is larger than in the case of cylindrical insertion. Incidentally, in the case of providing only the screw without providing the divided terminal, there arise demerits that a different member such as a lock nut is needed at the fastening portion, the whole length of the fixed side conductor is elongated, fastening work is complicated, and the like.

Furthermore, an air gap is provided by inserting the spacer 10 between the fixed side mounting plate 2 and the insulation support 3. However, an insulation medium heated by heat generation generated from the fixed side and the movable side of the vacuum interrupter 1 during energization can be flown to the outside of the insulation support 3 by providing the air gap; and therefore, heat dissipation performance is improved.

Further, in the case where there is not the spacer 10, the fixed side mounting plate 2 and the insulation support 3 come close to form a narrow space to be a triple junction. However, the formation of the triple junction can be suppressed by providing the spacer 10 and the generation of discharge from the vicinity of a mounting portion of the fixed side mounting plate 2 can be suppressed.

Incidentally, in the description so far, the insulation support 3 to which the fixed side mounting plate 2 is attached is the cylindrical insulation support which contains the vacuum interrupter 1. More specifically, the fixed side mounting plate 2 is fixed by using an end portion of the insulation support 3 which contains the vacuum interrupter 1, but is not limited to this. For example, in FIG. 1, a configuration may be such that an insulation support is arranged on the right side of the fixed side mounting plate 2 and the insulation support and the fixed side mounting plate are supported in a bridge form by at least two supporting portions at intervals. As in the case of FIGS. 1A and 1B, the fixed side mounting plate 2 is configured such that a plurality of plate-like members are overlapped; and the fixed side conductor 1*d* of the vacuum interrupter 1 is supported at substantially the center of two supporting portions of the fixed side mounting plate directly or via an impact force transmitting member. The impact force transmitting member does not particularly need a conductive function and the shape thereof may be a structure of the divided terminal like FIG. 2 or may be a structure without the slit.

As described above, the switching apparatus according to Embodiment 1 includes: the vacuum interrupter in which the fixed contact and the movable contact are contained in the vacuum vessel; the fixed side mounting plate which supports the fixed side conductor connected to the fixed contact; the insulation support which supports the fixed side mounting plate in the bridge form by at least two supporting portions at intervals; and the operating mechanism which is coupled to the movable side conductor connected to the movable contact and performs opening and closing operation of both the contacts. In the switching apparatus, the fixed side mounting plate is configured such that the plurality of plate-like members are overlapped; and the fixed side conductor of the vacuum interrupter is supported at substantially the center of the two supporting portions of the fixed side mounting plate directly or via the impact force transmitting member. Therefore, the collision energy during contact closing operation is attenuated by the fixed side mounting plate portion and chattering between the contacts can be effectively suppressed.

Furthermore, the switching apparatus includes: the vacuum interrupter in which the fixed contact and the movable contact are contained in the vacuum vessel; the fixed side mounting plate which supports the fixed side conductor connected to the fixed contact; and the cylindrical insulation support in which the vacuum interrupter is contained in the inside and to which the fixed side mounting plate is firmly fixed at one end side; and the operating mechanism which is coupled to the movable side conductor connected to the movable contact and performs opening and closing operation of both the contacts. In the switching apparatus, the fixed side mounting plate is configured such that the plurality of plate-like members are overlapped; the exposed portion of the fixed side conductor exposed to the outside of the vacuum vessel is attached with the divided terminal which has the fitting hole to be fitted to the exposed portion and is formed with the slit in the radial direction from the fitting hole; and the divided terminal is fixed to the fixed side mounting plate, and the fixed side conductor of the vacuum interrupter is supported by the fixed side mounting plate via the divided terminal. Therefore, the collision energy during contact closing operation is attenuated by the divided terminal and the fixed side mounting plate portion and chattering between the contacts can be effectively suppressed.

Furthermore, by using the divided terminal, the number of laminated sheets of the fixed side mounting plate can be reduced and a reduction in size of the switching apparatus can be achieved.

Moreover, the fixed side mounting plate is configured such that two plate-like members having the same outer shape are overlapped; and therefore, there can be obtained the fixed side mounting plate having a spring constant effective for suppression of chattering by a simple configuration.

Additionally, the portion serving as the corner portion of the outer periphery of the overlapped fixed side mounting plate is formed in the curved face; and therefore, an electric field of the outer peripheral portion of the fixed side mounting plate that becomes a high electric field can be relaxed without providing a particular electric field relaxation shield or the like.

In addition, the through hole is provided at the central portion of the fixed side mounting plate and the fixed side conductor or the fixed side connection terminal of the vacuum interrupter passes through the through hole and is led out to the outside of the fixed side mounting plate; and therefore, the external main circuit conductor can be easily connected to the fixed contact side of the vacuum interrupter.

Besides, the spacer is interposed at a fixing portion between the fixed side mounting plate and the insulation support; and therefore, the insulation medium heated by heat generation generated from the vacuum interrupter during energization can be flown to the outside of the insulation support by providing the air gap by the spacer, thereby improving heat dissipation performance. Furthermore, the spacer is applied; and thus, the formation of the triple junction of a proximity portion of the fixed side mounting plate and the insulation support can be suppressed and the generation of discharge from the vicinity of the fixed side mounting plate can be suppressed.

Embodiment 2

Figure 5:
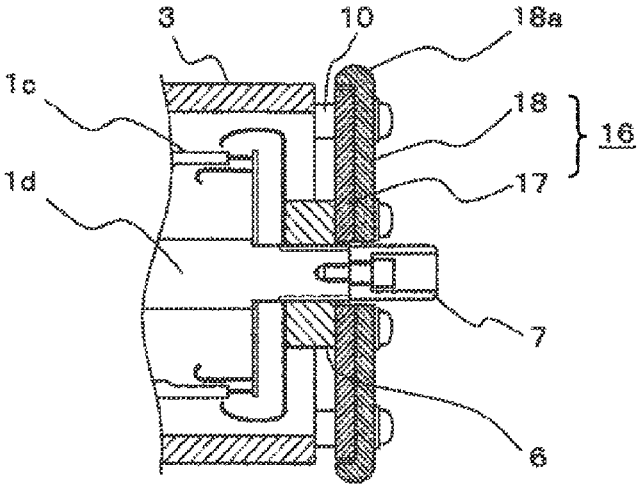
FIG. 5 is a partial sectional view of a relevant part showing a switching apparatus according to Embodiment 2 of the present invention.

FIG. 5 is a partial sectional view representing by enlarging only the vicinity of the fixed side of a vacuum interrupter of a switching apparatus according to Embodiment 2. A configuration other than shown in the drawing is equivalent to FIGS. 1A and 1B of Embodiment 1 and therefore the description thereof will be omitted; and a description will be made centering on a different point. The different point is the configuration of a fixed side mounting plate.

In FIG. 5, the configuration is made such that a fixed side mounting plate 16 of the present embodiment is composed of two plates; however, two plates are not the same shape and two kinds of different shaped plate-like members 17, 18 are laminated. The configuration is made such that the outer shape of the plate-like member 17 on the side facing the vacuum interrupter 1 is made to be small; the outer shape of the plate-like member 18 serving as the outside is made to be large and the thickness thereof is also made to be thick; a concave portion is formed on one surface of the plate-like member 18; and the plate-like member 17 is fitted into the concave portion to be overlapped.

A curved face portion 18*a* formed with a large curvature is provided on the outer periphery of the plate-like member 18 serving as the outside.

Next, operation will be described.

In the case where the switching apparatus is applied to a higher voltage rating, an electric field around the fixed side mounting plate needs to be further reduced. In order to do this, it is desired to adopt an electric field relaxation structure having a large curved surface on the outer periphery of the fixed side mounting plate. However, when the thickness of each laminating plate-like member is thickened in order to secure a larger curved surface, a spring constant of the whole fixed side mounting plate increases and accordingly it is difficult to be within the range of the spring constant described in Embodiment 1.

Consequently, as shown in FIG. 5, the plate-like member 17 is fitted into the inside of the plate-like member 18 in which the thickness of only the outer periphery of the mounting plate is thickened; and thus, the whole spring constant does not largely fluctuate from the fixed side mounting plate configured like Embodiment 1 and the large curved face portion 18*a* necessary for electric field relaxation can be formed.

As described above, according to the switching apparatus of Embodiment 2, the configuration is made such that the fixed side mounting plate is composed of two plate-like members having the different outer shapes, the concave portion is formed on one surface of the plate-like member having the larger outer shape, and the plate-like member having the smaller outer shape is fitted into the concave portion to be overlapped; and therefore, the large curved face necessary for electric field relaxation can be obtained while securing the desired spring constant with respect to the fixed side mounting plate.

Embodiment 3

Figure 6:
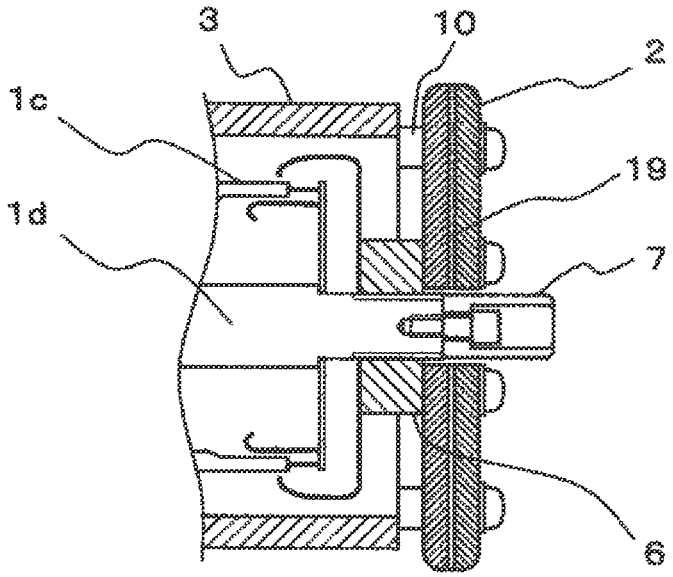
FIG. 6 is a partial sectional view of a relevant part showing a switching apparatus according to Embodiment 3 of the present invention.

FIG. 6 is a partial sectional view representing by enlarging only the vicinity of the fixed side of a vacuum interrupter of a switching apparatus according to Embodiment 3. A configuration other than shown in the drawing is equivalent to FIGS. 1A and 1B of Embodiment 1 and therefore the description thereof will be omitted; and a description will be made centering on a different point. The different point is the configuration of a fixed side mounting plate portion.

In FIG. 6, a thin plate 19 made of a material which is lower in rigidity and lighter than a fixed side mounting plate 2 is inserted between two plate-like members composing the fixed side mounting plate 2. The thin plate 19 is inserted; and thus, there can be obtained effects in which the number of laminated sheets is increased without almost changing a spring constant of the fixed side mounting plate 2 portion and the whole mass of the fixed side mounting plate 2 portion and vibration damping due to friction generated between the plates when the fixed side mounting plate 2 is distorted is increased.

Incidentally, the configuration in which the thin plate is inserted can be also applicable to FIG. 5 of Embodiment 2.

As described above, according to the switching apparatus of Embodiment 3, the thin plate whose rigidity is lower and whose thickness is thinner than the fixed side mounting plate is nipped between two plate-like members composing the fixed side mounting plate; and therefore, the spring constant of the fixed side mounting plate portion can be easily adjusted so as to be within a predetermined range without largely changing the whole structure. Thus, there can be dealt with a change in structure associated with specification modification around the vacuum interrupter and/or the operating mechanism.

Embodiment 4

Figure 7:
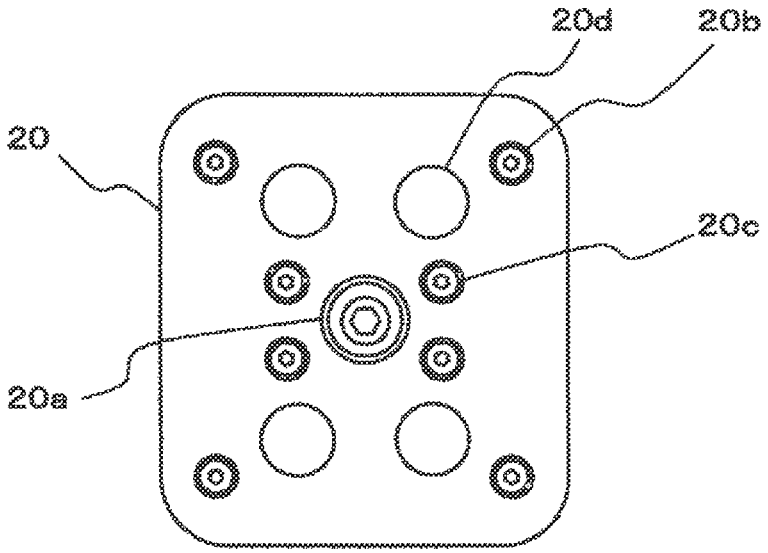
FIG. 7 is a plan view showing a fixed side mounting plate portion for use in a switching apparatus according to Embodiment 4 of the present invention.

FIG. 7 is a plan view of a fixed side mounting plate portion of a switching apparatus according to Embodiment 4 and is a view seen in the axial direction of a vacuum interrupter 1. The basic configuration of the switching apparatus is equivalent to FIGS. 1A and 1B of Embodiment 1 and therefore the illustration and description thereof will be omitted; and a description will be made centering on a different point.

A fixed side mounting plate 20 of the present embodiment is also composed of two plate-like members; and a manner of two plate configuration is equivalent to any one of Embodiment 1 to 3.

In the fixed side mounting plate 20 composed of two plate-like members in FIG. 7, a through hole 20*a* through which the fixed side conductor 1*d* and the fixed side connection terminal 7 or the connection conductor 15 pass through is provided at a central portion; fixing holes 20*b* for fixing to the insulation support 3 are formed in the vicinity of rim portions; and mounting holes 20*c* for connecting to the divided terminal 6 are provided on the outside of the through hole 20*a*. The configuration described so far is similar to that of Embodiments 1 to 3; however, as a characterized portion of the present embodiment, ventilation holes 20*d* are further provided on the outside of the mounting holes 20*c* and on the inside of the fixing holes 20*b*. Naturally, in a state where the ventilation holes 20*d* are formed, the thickness and the size of the plate-like member are set so that the whole spring constant of the fixed side mounting plate 20 is within the range described in Embodiment 1. Furthermore, a curved face portion for electric field relaxation is provided on an outer peripheral portion and this is also similar to the fixed side mounting plate described so far.

By such a configuration, an insulation medium heated by the vacuum interrupter 1 and the energization portion arranged in the insulation support 3 can be effectively flown from the ventilation holes 20*d* to the outside.

Incidentally, in FIG. 7, the outer shape of the fixed side mounting plate 20 is a rectangle, but is not limited to this and may be a circle.

As described above, according to the switching apparatus of Embodiment 4, the ventilation holes to be communicated to the inside of the insulation support are provided in the fixed side mounting plate; and therefore, the insulation medium that becomes high temperature by the heat generated by the apparatus contained in the insulation support can be effectively ventilated and temperature rise can be suppressed.

Incidentally, the present invention can freely combine the respective embodiments and appropriately change or omit the respective embodiments, within the scope of the present invention.

DESCRIPTION OF REFERENCE NUMERALS

1: Vacuum interrupter valve, 1*a*: Fixed contact, 1*b*: Movable contact, 1*c*: Vacuum vessel, 1*d*: Fixed side conductor, 1*e*: Movable side conductor, 1*f*: Bellows, 2: Fixed side mounting plate, 2*a*: Through hole, 2*b*: Curved face portion, 3: Insulation support, 4: Coupling rod, 5: Insulation rod, 6: Divided terminal, 6*a*: Fitting hole, 6*b*: Slit, 6*c*: Flat portion, 6*d*: Mounting hole, 7: Fixed side connection terminal, 8: Flexible conductor, 9: Movable side connection terminal, 10: Spacer, 11: Fixing plate, 12: Fastening screw, 13: Divided terminal, 13*a*: Fitting hole, 13*b*: Slit, 13*c*: Screwing hole, 13*d*: Mounting hole, 14: Fixed side conductor, 14*a*: Disc shaped portion, 15: Connection conductor, 16: Fixed side mounting plate, 17 and 18: Plate-like member, 18*a*: Curved face portion, 19: Thin plate, 20: Fixed side mounting plate, 20*a*: Through hole, 20*b*: Fixing hole, 20*c*: Mounting hole, and 20*d*: Ventilation hole.

The invention claimed is:

1. A switching apparatus comprising:

a vacuum interrupter in which a fixed contact and a movable contact are contained in a vacuum vessel;

a fixed side mounting plate which supports a fixed side conductor connected to said fixed contact; and a cylindrical insulation support in which said vacuum interrupter is contained in the inside and to which said fixed side mounting plate is firmly fixed at one end side; and an operating mechanism which is coupled to a movable side conductor connected to said movable contact and performs opening and closing operation of both said contacts, wherein said fixed side mounting plate is configured such that a plurality of plate-like members are overlapped;

an exposed portion of said fixed side conductor exposed to the outside of said vacuum vessel is attached with a divided terminal which has a fitting hole to be fitted to the exposed portion and is formed with a slit in a radial direction from the fitting hole; and said divided terminal is fixed to said fixed side mounting plate, and said fixed side conductor of said vacuum interrupter is supported by said fixed side mounting plate via said divided terminal.

2. The switching apparatus according to claim 1, wherein said fixed side mounting plate is configured such that two plate-like members having the same outer shape are overlapped.

3. The switching apparatus according to claim 2, wherein a thin plate whose rigidity is lower and whose thickness is thinner than said fixed side mounting plate is nipped between two plate-like members composing said fixed side mounting plate.

4. The switching apparatus according to claim 1, wherein a configuration is made such that said fixed side mounting plate is composed of two plate-like members having different outer shapes, a concave portion is formed on the plate-like member having a larger outer shape, and the plate-like member having a smaller outer shape is fitted into the concave portion to be overlapped.

5. The switching apparatus according to claim 4, wherein a thin plate whose rigidity is lower and whose thickness is thinner than said fixed side mounting plate is nipped between two plate-like members composing said fixed side mounting plate.

6. The switching apparatus according to claim 1, wherein a portion serving as a corner portion of the outer periphery of said overlapped fixed side mounting plate is formed in a curved face.

7. The switching apparatus according to claim 1, wherein a through hole is provided at a central portion of said fixed side mounting plate and said fixed side conductor or said fixed side connection terminal of said vacuum interrupter passes through the through hole and is led out to the outside of said fixed side mounting plate.

8. The switching apparatus according to claim 1, wherein a fixing portion between said fixed side mounting plate and said insulation support is interposed with a spacer.

9. The switching apparatus according to claim 1, wherein a ventilation hole to be communicated to the inside of said insulation support is provided in said fixed side mounting plate.

* * * * *